US011565291B2

(12) United States Patent
Pacher et al.

(10) Patent No.: US 11,565,291 B2
(45) Date of Patent: Jan. 31, 2023

(54) ROLLING MILL FOR SOLID ELONGATED PRODUCTS

(71) Applicant: SMS GROUP S.p.A., Udine (IT)

(72) Inventors: Marcello Pacher, Udine (IT); Nicola Maria Tuzio, Udine (IT); Paolo Marin, Udine (IT)

(73) Assignee: SMS GROUP S.p.A., Tarcento (IT)

( * ) Notice: Subject to any disclaimer, the term of this patent is extended or adjusted under 35 U.S.C. 154(b) by 0 days.

(21) Appl. No.: 17/496,480

(22) Filed: Oct. 7, 2021

(65) Prior Publication Data

US 2022/0111429 A1 Apr. 14, 2022

(30) Foreign Application Priority Data

Oct. 8, 2020 (IT) ..... 102020000023752

(51) Int. Cl.
*B21B 31/10* (2006.01)
*B21B 13/10* (2006.01)
(Continued)

(52) U.S. Cl.
CPC ..... *B21B 13/103* (2013.01); *B21B 13/04* (2013.01); *B21B 17/14* (2013.01); *B21B 31/18* (2013.01)

(58) Field of Classification Search
CPC ..... B21B 13/103; B21B 17/14; B21B 31/02; B21B 31/10; B21B 35/025; B21B 35/04;
(Continued)

(56) References Cited

U.S. PATENT DOCUMENTS 7,849,723 B2 * 12/2010 Cernuschi ..... B21B 31/02 72/235
8,341,994 B2 * 1/2013 Ettore ..... B21B 17/04 72/235
(Continued)

FOREIGN PATENT DOCUMENTS

DE 693 02 789 T2 11/1996
EP 1 449 597 A2 8/2004
(Continued)

OTHER PUBLICATIONS

Italian Search Report for Italian Patent Application No. 102020000023752 dated Jun. 1, 2021, 4 pages.

*Primary Examiner* — Edward T Tolan
(74) *Attorney, Agent, or Firm* — Merchant & Gould P.C.

(57) ABSTRACT

A rolling mill for solid elongated products, defining a rolling axis, including first and second rolling stations. Each station includes a load-bearing structure, a removable roll-holder cartridge with three rolling rolls movable radially and rotating around three equally spaced axes of rotation, and a roll having a vertical rotational axis. Three actuators mount on the load-bearing structure; three gear motor groups connect to the rolls by single extensions. The position of the second station rolls is rotated 60° from the first stations. The rolls with a vertical axis of the first and second stations are arranged on opposite sides of the rolling axis. All rolling stations allow lateral extraction of roll-holder cartridges from the same side of the rolling mill. The stations on the cartridge extraction side have actuators movable relative to the load-bearing structure. The stations with vertical rolls arranged on the opposite side have fixed actuators.

19 Claims, 14 Drawing Sheets

(51) Int. Cl.

| | |
|---|---|
| ***B21B 13/04*** | (2006.01) |
| ***B21B 17/14*** | (2006.01) |
| ***B21B 31/18*** | (2006.01) |

(58) Field of Classification Search
CPC ..... B21B 2203/06; B21B 31/18; B21B 31/20; B21B 2203/08
See application file for complete search history.

(56) References Cited

U.S. PATENT DOCUMENTS

| | | | | |
|---|---|---|---|---|
| 8,857,235 | B2 * | 10/2014 | Marin | B21B 35/04 72/235 |
| 9,550,220 | B2 * | 1/2017 | Cernuschi | B21B 31/10 |
| 9,573,177 | B2 * | 2/2017 | Cernuschi | B21B 31/08 |
| 2003/0217579 | A1 * | 11/2003 | Bindernagel | B21B 35/04 72/239 |
| 2014/0182346 | A1 * | 7/2014 | Marin | B21B 13/00 72/252.5 |

FOREIGN PATENT DOCUMENTS

| | | | |
|---|---|---|---|
| EP | 2 560 771 | B1 | 7/2014 |
| EP | 2 983 840 | B1 | 6/2017 |
| WO | 2009/141414 | A1 | 11/2009 |

* cited by examiner

ROLLING MILL FOR SOLID ELONGATED PRODUCTS

CROSS-REFERENCE TO RELATED APPLICATION

This application claims benefit of Ser. No. 102020000023752, filed 8 Oct. 2020, and which application is incorporated herein by reference. To the extent appropriate, a claim of priority to made to the above-disclosed application.

FIELD OF APPLICATION

The present invention relates to a rolling mill for solid elongated products, such as for example bars, rods and wire rods.

Advantageously, the rolling mill according to the invention is intended in particular to carry out a finishing rolling.

PRIOR ART

The longitudinal rolling of solid elongated products has been carried out for several years by multi-cage rolling mills with motorized rolls.

A multi-cage rolling mill comprises a plurality of rolling stations arranged in series along the rolling axis. Each station comprises a plurality of rolling rolls inserted in a roll-holder cartridge or cage.

Generally, each cage is provided with three rolls, although solutions with two or four roll cages have been proposed. Operationally, the position of the rolls of each cage may be adjusted by changing the radial distance of each roll from the rolling axis so as to be able to vary the rolling action as a function of the diameter to be obtained on the elongated product being processed.

The term "finishing rolling" is used herein to refer to that step in the processing of elongated products in the steel industry, such as for example bars, rods, or wire rods, in which an elongated semi-finished product is subjected to longitudinal rolling by rolls up to its final size. This processing essentially leads to a reduction in the size of the semi-finished product until its nominal value is reached.

As is known, the rolling rolls are subject to wear and damage and must be regularly replaced. Therefore, in the operational management of the rolling mills, an easy replacement of the rolls becomes essential.

Generally, in multi-cage rolling mills, the replacement of a roll is carried out by first extracting the respective cage from the structure of the rolling mill.

Typically, multi-cage rolling mills are configured for lateral extraction of the cages, that is, obtainable through a movement of the cages orthogonal to the rolling axis.

Multi-cage rolling mills are known which allow the lateral extraction of all the cages from the same side of the rolling mill. This is very advantageous as it simplifies the logistics of managing the cages themselves.

An example of a multi-cage rolling mill with extraction of all the cages from the same side is shown in FIGS. 1 and 2.

More in detail, the rolling mill generally comprises four or five cages placed in series along the rolling axis. Each cage S is provided with three rolls R1, R2 and R3 equally distributed at 120° with respect to one another about the rolling axis X. One of the three rolls R1 has a horizontal axis of rotation. The odd cages have the rolls rotated by 60° about the rolling axis with respect to the even ones in order to roll the material with the groove bottom of the respective rolls at the portion of the product which in the previous cage was not affected by the action of the rolls. With this configuration, the odd cages are overturned with respect to the even ones about a horizontal axis. Each roll is provided with its own adjustment actuator A1, A2 and A3, in particular of the hydraulic type, mounted on the fixed structure F of the rolling mill. The actuators A1, A2 and A3 have the purpose of adjusting the radial distance of each roll from the rolling axis so as to be able to vary the rolling action as a function of the diameter to be obtained on the elongated product being processed. The adjustment actuators are radially aligned with the respective rolls and are therefore equally distributed at 120° about the rolling axis X. In the configuration illustrated, one of the three actuators is therefore arranged along the vertical direction passing through the rolling axis. FIGS. 1 and 2 show a section of the rolling mill at an even cage.

The control system of the rolling mill comprises a single motor M for each cage, which is connected to the respective rolls by a three-output gear distributor group RD. The horizontal axis roll R1 is connected directly to the distributor gear group by a kinematic connection extension L1, while each of the two inclined rolls R2 and R3 is connected to the gear distributor group RD by a double extension L2+L2' and L3+L3' interspersed with a special angular gearbox G2, G3. The motors and the distributor gear groups of the different cages are all positioned on the same side of the rolling mill, so as to leave the opposite side free for the extraction of the cages. During the cage extraction step to allow the creation of a free path for the movement of the cage, the hydraulic actuator A2 of the roll R2 positioned on the cage extraction side is rotatable (in the figures it is shown in a rotated non-operative condition) so that it may be temporarily moved from the extraction path.

Although such rolling mill solution is effective, it nevertheless has some limitations.

The control system is complex and expensive, comprising for each cage a three-output gear distributor group RD and special angular gearboxes G2 and G3 with an angle between the input and output shaft of approximately 50°-60°.

Furthermore, the special angular gearbox G2 which is arranged below the rolling mill and which is connected to the respective roll with an extension L2' at 30° with respect to the vertical is inevitably hit by the drainage of the cooling water. Once the gearbox G2 is reached, the water then infiltrates the lubrication system, thus reaching the other gearboxes. This causes corrosion problems affecting not only the double extension L2+L2' and the lower angular gearbox G2, but all gearboxes, imposing heavy maintenance costs.

A second example of a rolling mill with lateral extraction of the cages on the same side is illustrated in FIGS. 3 and 4. This rolling mill adopts a general configuration of the rolls and of the control system similar to that present in the rolling mill of FIG. 1. The radial adjustment system of the rolls is, however, integrated on the board of each roll-holder cartridge and consists of a mechanical adjustment system suitable to synchronously adjust the radial movements of the rolls. The motion to the adjustment system is provided by an external control C mounted on the fixed structure of the rolling mill on the extraction side of the cages. Such external control C is rotatable with respect to the fixed structure F so as to create a free path for the extraction of the cages.

Even in this solution, however, the aforementioned limits remain, linked to the complexity and cost of the control system and to the presence of special angular gearboxes placed under the rolling mill and therefore exposed to the drainage of the cooling water.

To overcome the aforementioned limits, multi-cage rolling mills have been proposed with:

- simplified control system which includes a gear motor group for each roll of each cage and a kinematic connection extension between the gear motor group and the respective roll without special angular gearboxes;
- (hydraulic) roll adjustment actuators, external to the cages and fixedly associated with the structure of the rolling mill;
- different arrangement of the three rolls inside the cages.

Multi-cage rolling mills of this type are described for example in WO2009141414A1 and EP2560771B1.

More in detail, each cage is provided with three rolls, equally distributed at 120° with respect to one another about the rolling axis. One of the three rolls has a vertical rather than a horizontal axis of rotation. The odd cages have the rolls rotated by 60° about the rolling axis with respect to the even ones. Each roll is provided with its own adjustment actuator, in particular of the hydraulic type, mounted on the fixed structure of the rolling mill. The adjustment actuators are radially aligned with the respective rolls and are therefore equally distributed at 120° about the rolling axis with one of them being therefore arranged in the horizontal direction passing through the rolling axis. By virtue of this arrangement of the rolls, as well as of the absence of special angular gearboxes arranged under the rolling mill, problems related to the infiltration of water into the lubrication system are avoided.

The extraction of each cage takes place on the side opposite to that where the roll with a vertical axis is located, after having cleared the path by moving the connection extension of one of the inclined rolls. With this configuration, however, the extraction of the cages may not take place on the same side of the rolling mill, but alternatively, i.e., even cages on one side and odd cages on the other.

Therefore, the rolling mills described in WO2009141414A1 and EP2560771B1, in the face of a significant simplification of the plant, do not have the operational advantages linked to the fact of being able to extract all the cages from the same side of the rolling mill.

To date, there are no multi-cage rolling mills that allow the extraction of all the cages from the same side of the rolling mill and at the same time have a simplified roll control system that does not require special angular gearboxes.

In the field of rolling mills for solid elongated products, the differentiation of roll calibrations requires roll changes more frequently. For this reason, in this field there is a greater need to have multi-cage rolling mills which combine the possibility of extracting all the cages from the same side with a simplified roll control system which does not require special angular gearboxes.

DISCLOSURE OF THE INVENTION

Therefore, the main object of the present invention is to eliminate or at least mitigate the drawbacks of the aforementioned prior art by providing a rolling mill for solid elongated products which combines the possibility of extracting all the cages from the same side with a simplified roll control system which does not require special angular gearboxes.

A further object of the present invention is to provide a rolling mill for solid elongated products which is constructively simple to manufacture, with substantially lower manufacturing costs than traditional solutions which allow all the cartridges to be extracted from the same side of the rolling mill.

BRIEF DESCRIPTION OF THE DRAWINGS

The technical features of the invention, according to the aforesaid objects, may clearly be seen in the content of the claims below, and its advantages will become more readily apparent in the detailed description that follows, made with reference to the accompanying drawings, which illustrate one or more purely exemplary and non-limiting embodiments thereof, in which:

Elements or parts of elements in common to the embodiments described below are referred to with the same reference numerals.

DETAILED DESCRIPTION

Figure 1:
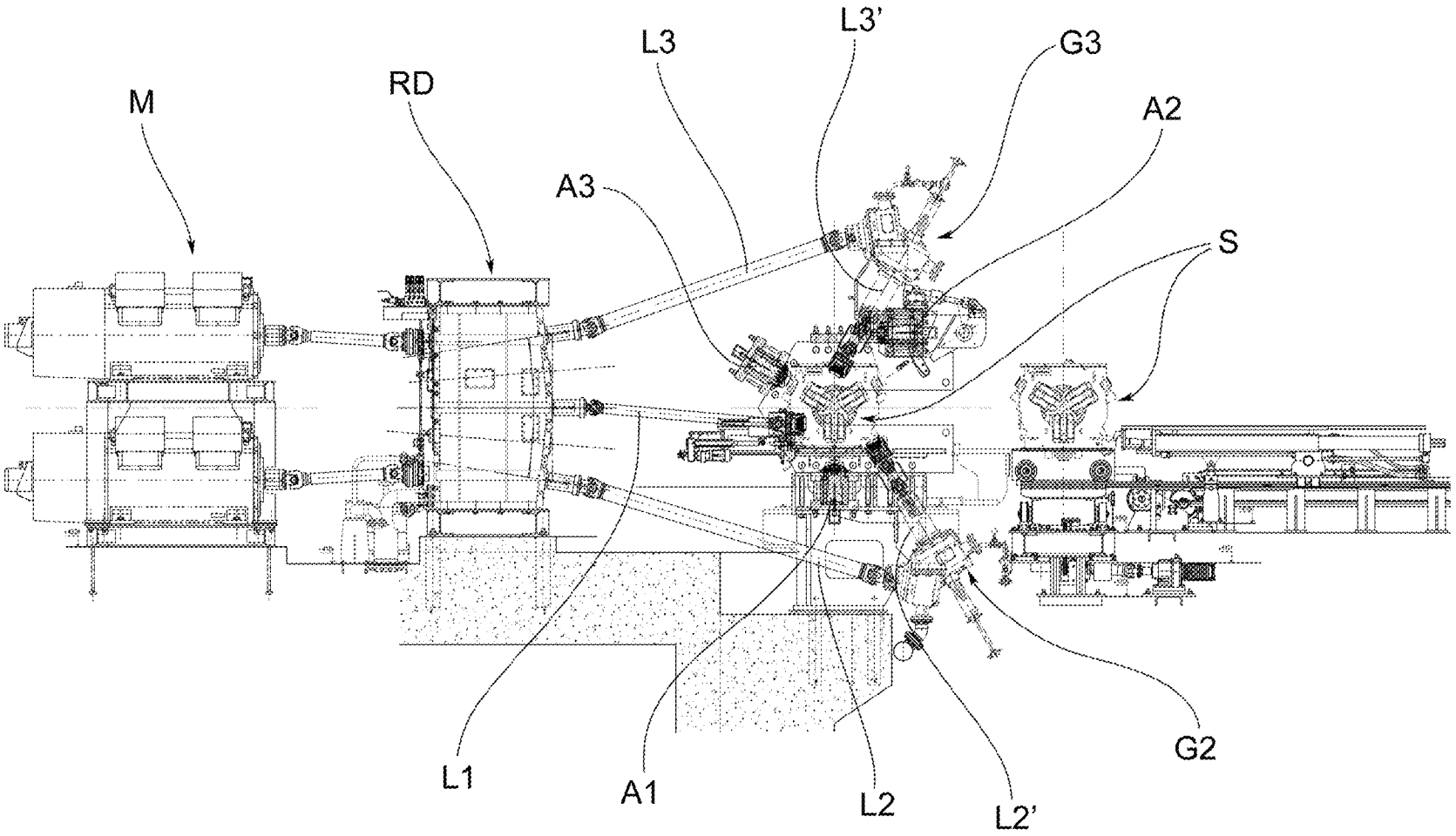
FIG. 1 shows a partial view of a first example of a rolling mill for solid elongated products of the traditional type configured to allow the extraction of all the cages from the same side of the rolling mill, the section being made at an even cage.
Figure 2:
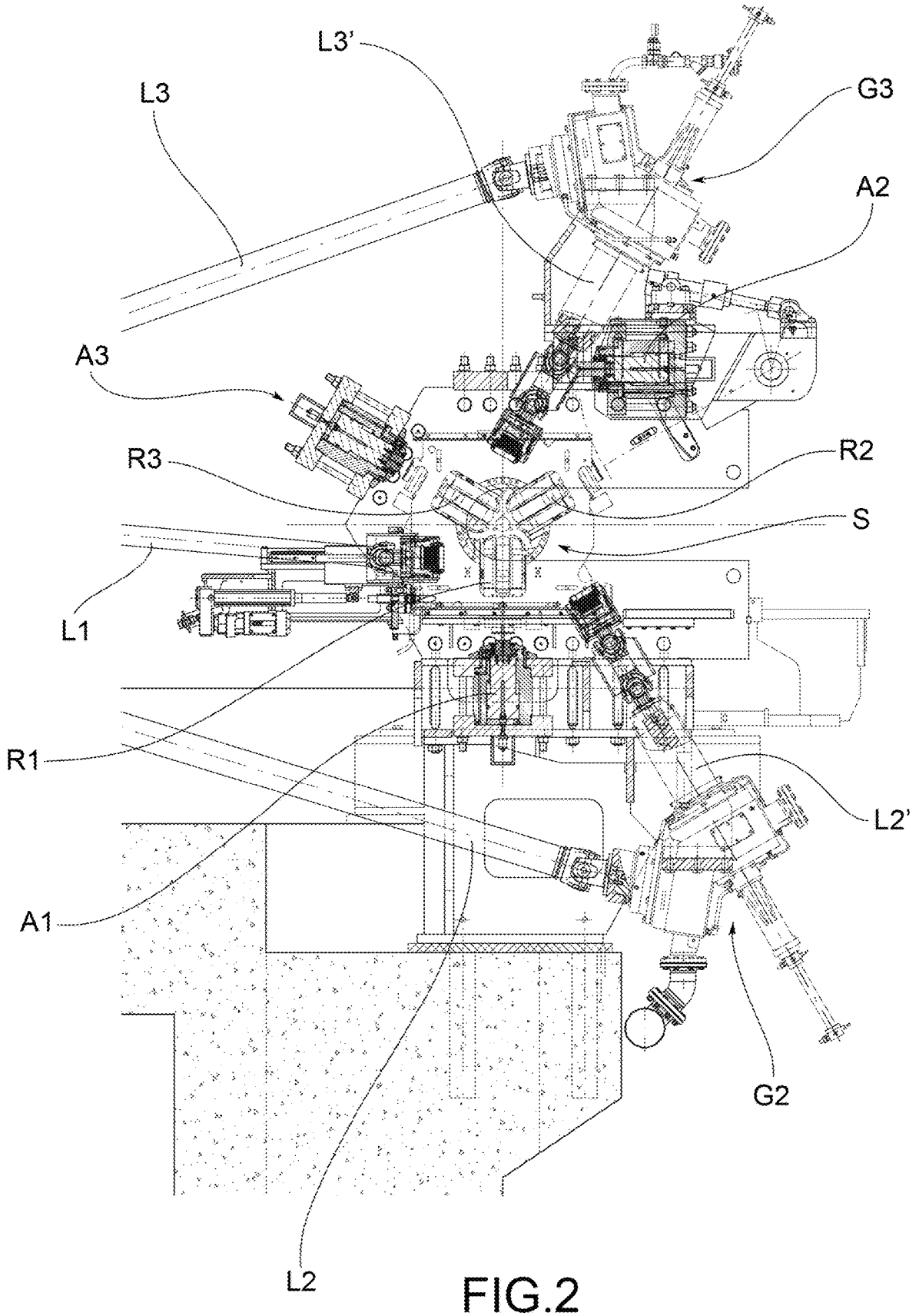
FIG. 2 shows an enlarged detail of the rolling mill of FIG. 1.
Figure 3:
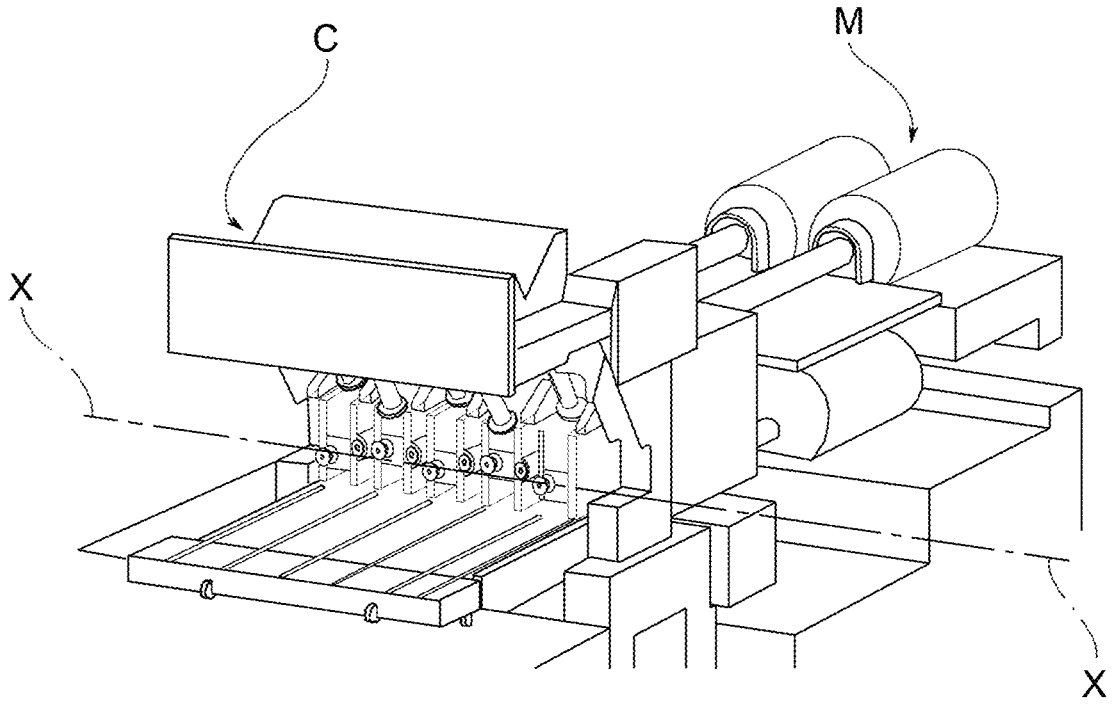
FIG. 3 shows a perspective view of a second example of a rolling mill for solid elongated products of the traditional type configured to allow the extraction of all the cages from the same side of the rolling mill, illustrated with an external control of the radial roll adjustment system in inoperative condition.
Figure 4:
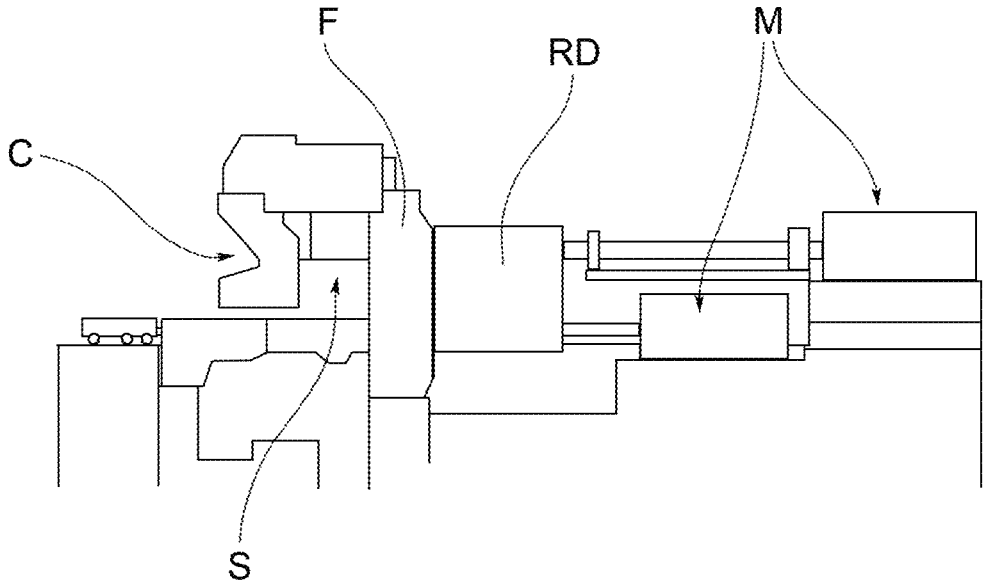
FIG. 4 shows an orthogonal side view of the rolling mill of FIG. 3, illustrated with the external control of the radial roll adjustment system in operative condition.

The present invention relates to a rolling mill for solid elongated products in the steel industry, such as bars, rods and wire rods.

Advantageously, the rolling mill according to the invention is intended in particular to carry out a finishing rolling.

The term "finishing rolling" is used herein to refer to that step in the processing of elongated products in the steel industry, such as for example bars, rods, or wire rods, in which an elongated semi-finished product is subjected to longitudinal rolling by rolls up to its final size. This processing essentially leads to a reduction in the size of the semi-finished product until its nominal value is reached.

With reference to the accompanying figures from 5 to 16, the reference numeral 1 indicates as a whole a rolling mill for solid elongated products of the iron and steel industry according to the invention.

Herein and in the following of the description and the claims, reference will be made to the rolling mill 1 in use condition. Therefore, any references to a lower or upper position or to a horizontal or vertical direction should be interpreted in such condition.

The rolling mill 1 for solid elongated products defines a rolling axis X, along which the elongated products to be rolled are made to slide.

Figure 5:
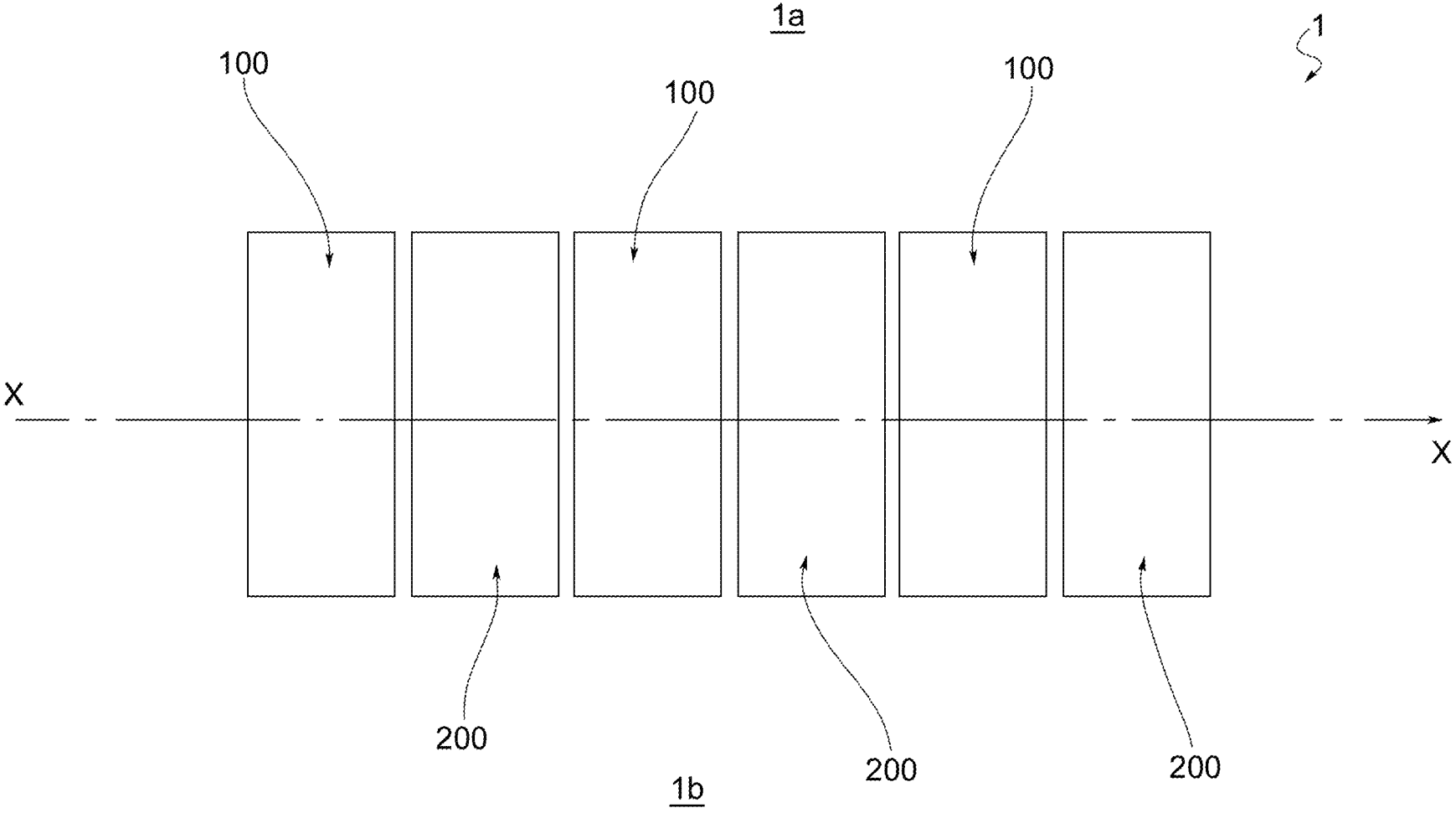
FIG. 5 shows a schematic view of the distribution of the rolling stations along the rolling axis in a rolling mill for solid elongated products according to the invention.

According to a general embodiment of the invention, the rolling mill 1 comprises a first plurality of rolling stations 100 and a second plurality of rolling stations 200 placed in series along the rolling axis X and alternated with each other between an input and an output of the rolling mill 1. This configuration of the rolling mill 1 is schematically represented in FIG. 5, where the individual stations 100 and 200 (by way of example in the total number of six) are schematically illustrated by rectangles.

Each of the aforementioned rolling stations 100 or 200 comprises:

- a load-bearing structure 110, 210, and
- a roll-holder cartridge 120, 220 which is connected in a removable manner to the load-bearing structure 110, 210, so that it may be extracted from the load-bearing structure itself and be replaced and/or subjected to maintenance.

Preferably, as illustrated in FIGS. 8 to 15, the load-bearing structures 110, 210 of the rolling stations are fixed to a common ground support base 2, which extends parallel to the aforementioned rolling axis X.

Advantageously, each load-bearing structure 110, 210 defines an operative housing seat 4 for a roll-holder cartridge. Such housing seat 4 is delimited at the bottom by a horizontal bottom wall 5 which acts as a support base for the roll-holder cartridge 120, 220 inside the housing seat 4.

Preferably, the load-bearing structure of each station may comprise a support structure 6 for the cartridges which constitutes an extension of the aforementioned horizontal bottom wall 5 outside the housing seat 4. This support structure 6 acts as a support base for the cartridges outside the housing seat 4.

Figure 11:
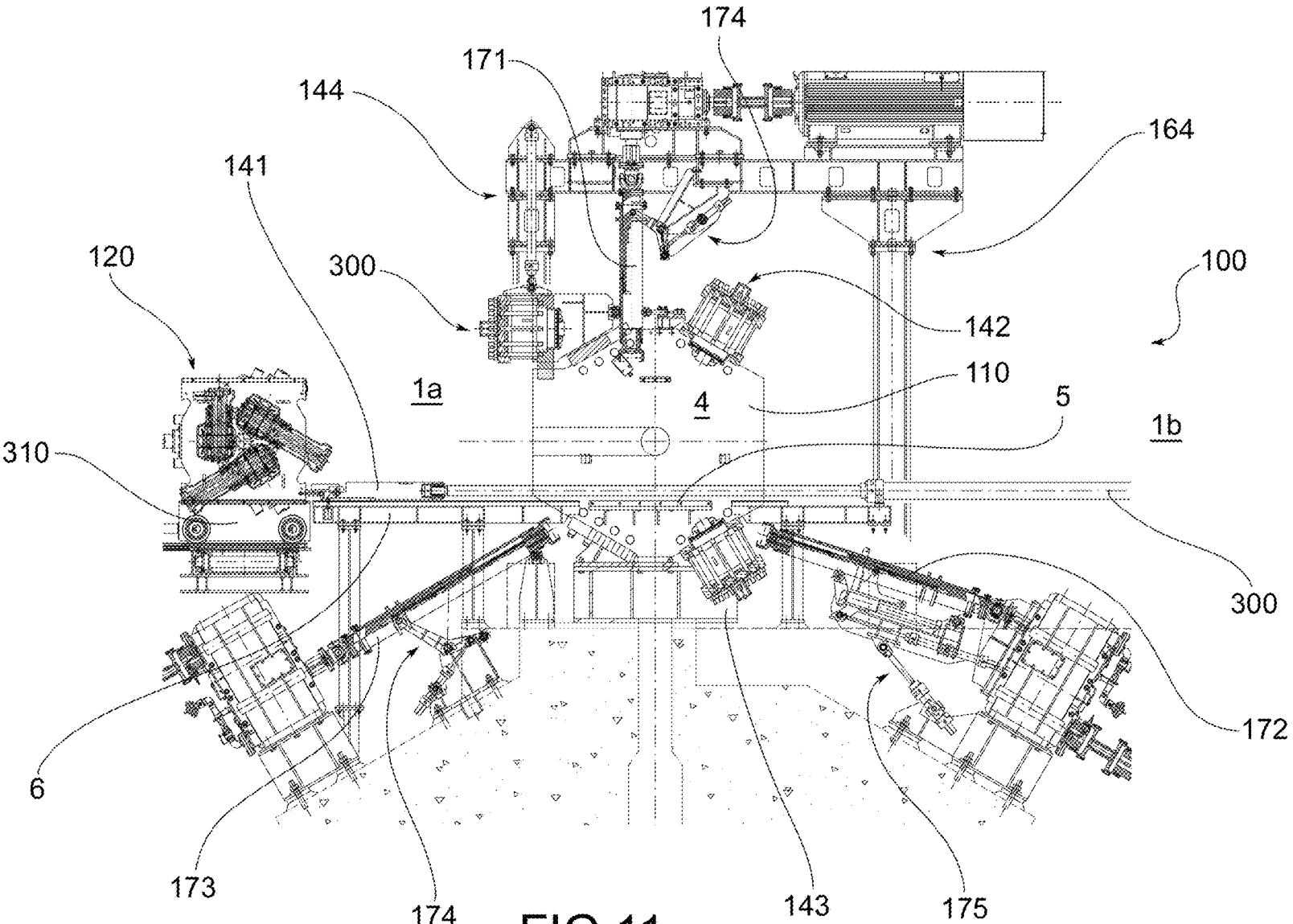
FIG. 11 shows an enlarged view of a part of the rolling mill illustrated in FIG. 10.
Figure 12:
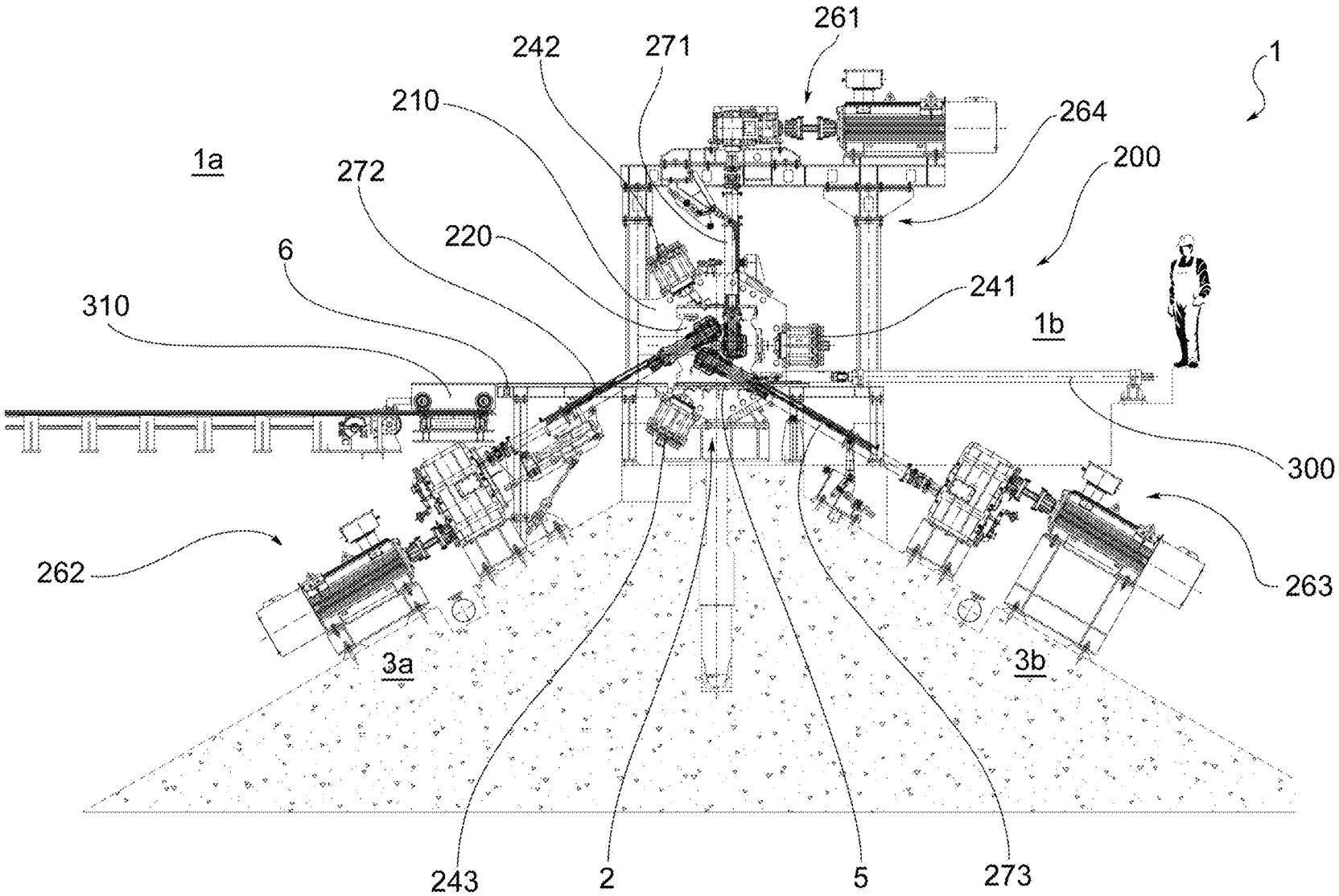
FIG. 12 shows a sectional view of a preferred embodiment of a rolling mill according to the invention, said section being made on a plane orthogonal to the rolling axis immediately upstream of the inlet of a station of a second plurality of stations, said station being shown with the relative roll-holder cartridge in the operative position, already operatively connected to the roll control system and to the actuation device of the roll adjustment system.
Figure 15:
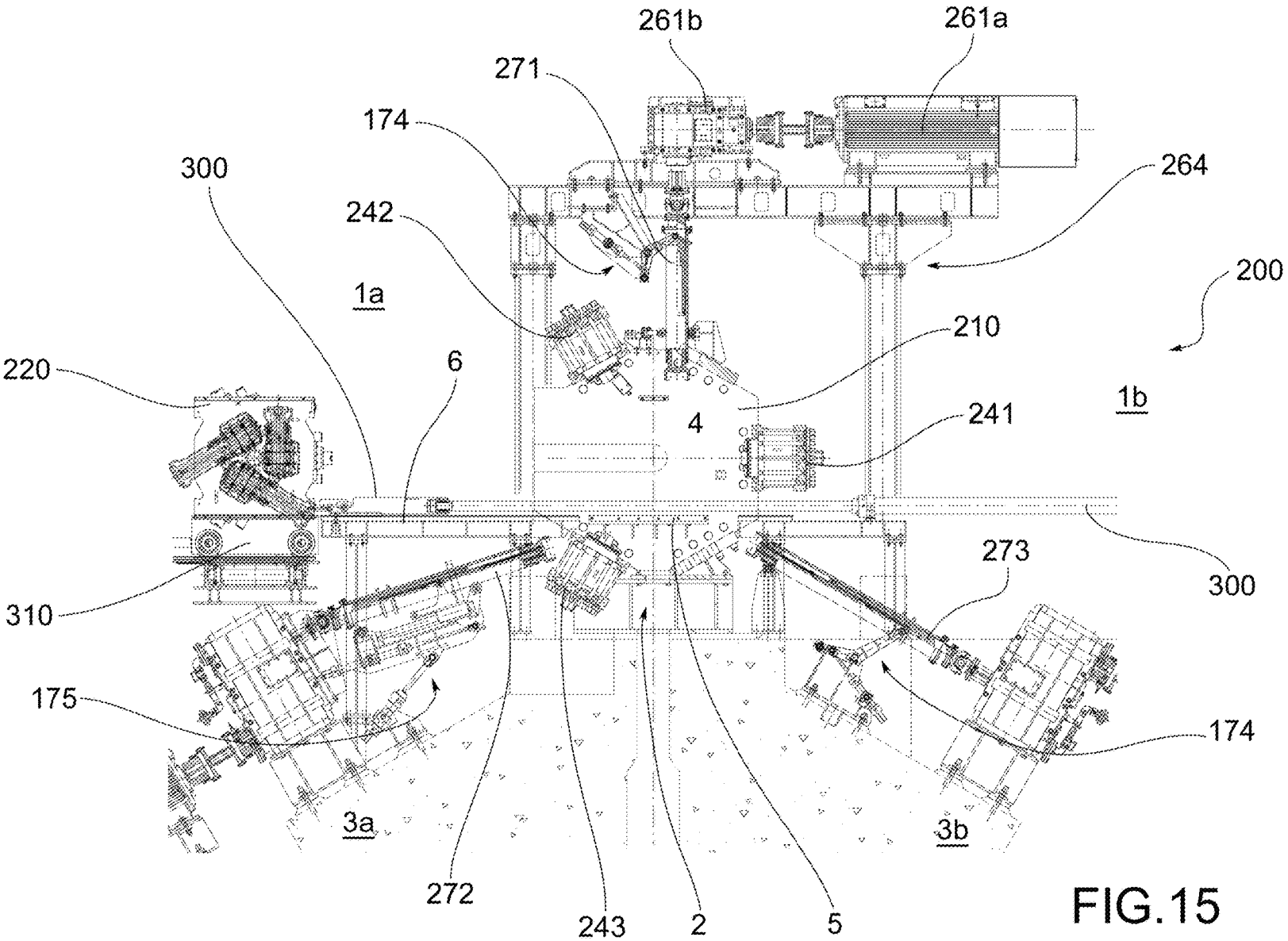
FIG. 15 shows an enlarged view of a part of the rolling mill illustrated in FIG. 14.

As illustrated for example in FIGS. 11 and 15, each roll-holder cartridge 120 or 220 comprises three rolling rolls 131, 132, 133 or 231, 232, 233, mounted on the cartridge itself so as to be radially movable with respect to the rolling axis X along respective radial axes T1, T2, T3 passing through the rolling axis.

Figure 7:
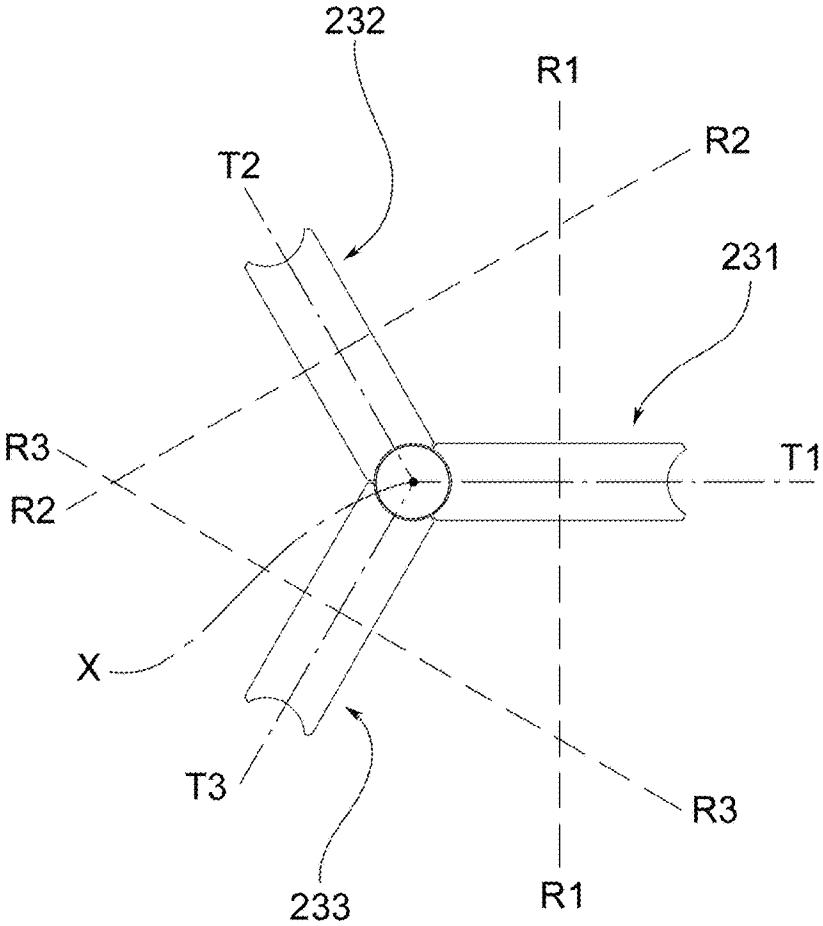
FIG. 7 shows a schematic view of the arrangement of the rolls in a rolling station of a rolling mill according to the invention, belonging to a second plurality of rolling stations.
Figure 6:
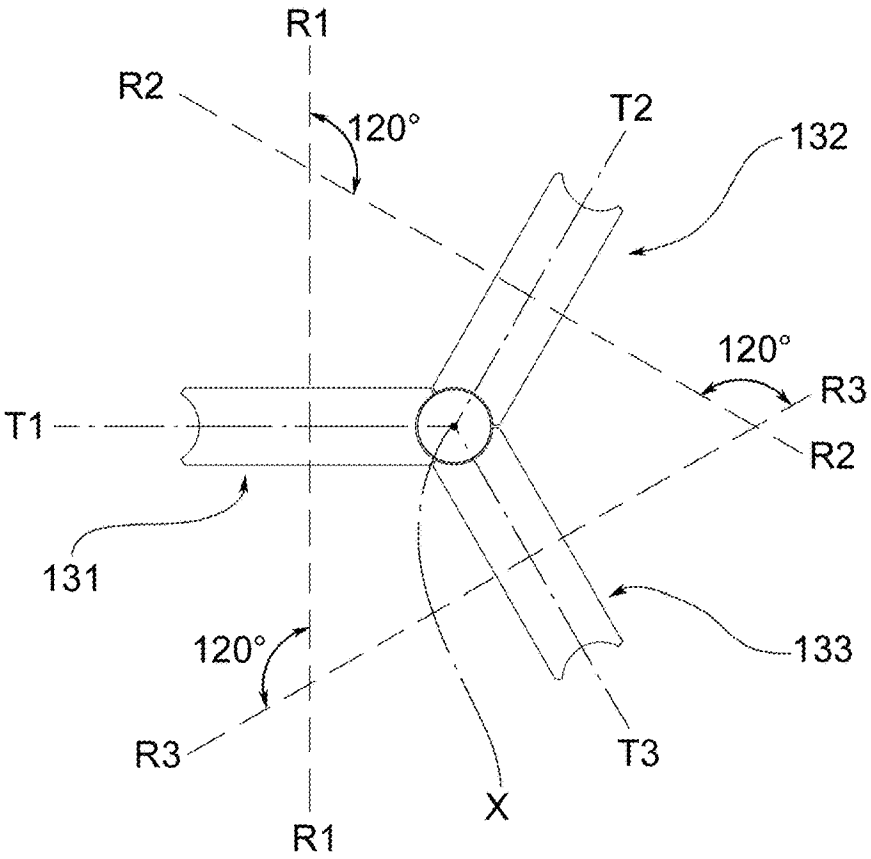
FIG. 6 shows a schematic view of the arrangement of the rolls in a rolling station of a rolling mill according to the invention, belonging to a first plurality of rolling stations.
Figure 8:
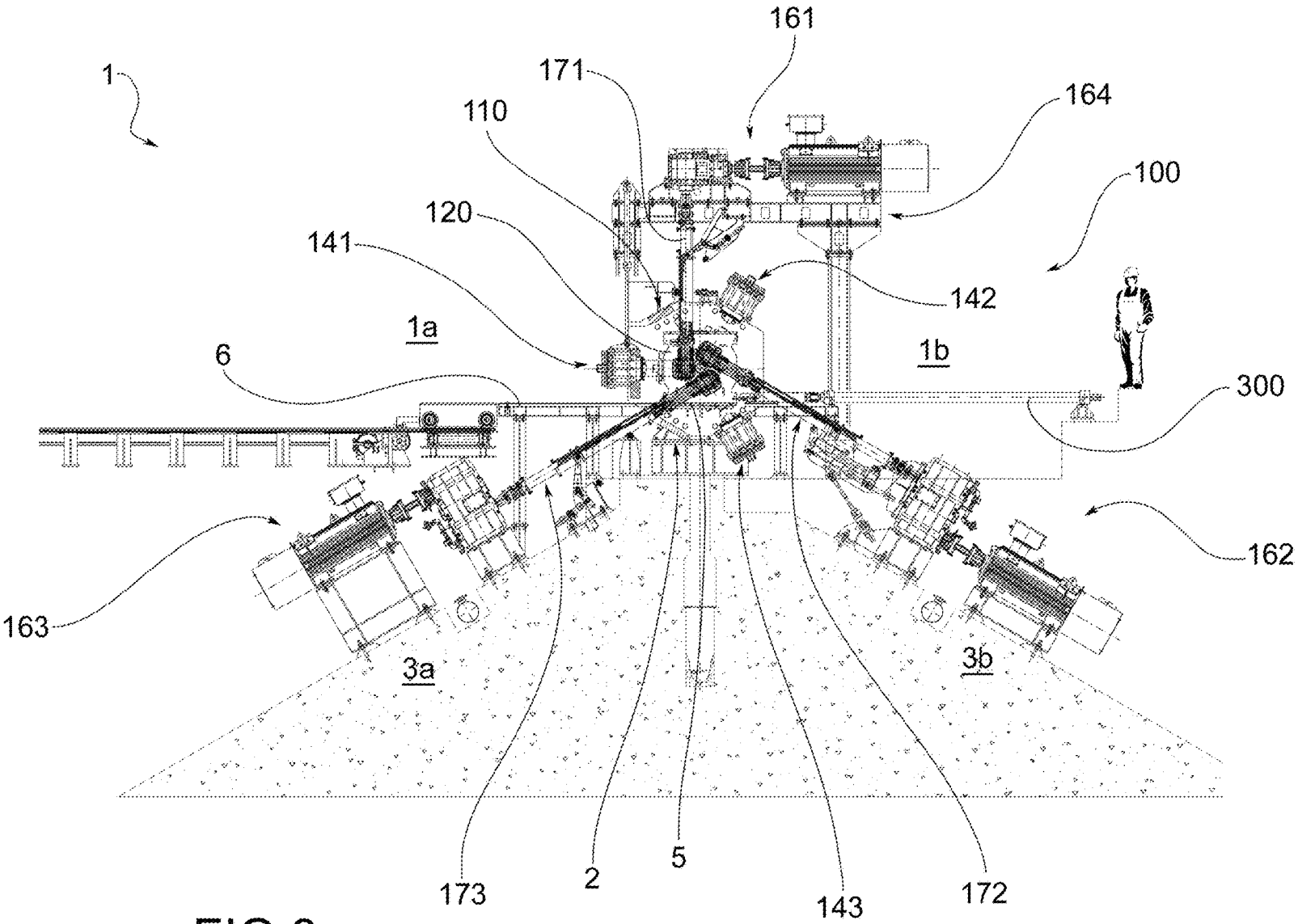
FIG. 8 shows a sectional view of a preferred embodiment of a rolling mill according to the invention, said section being made on a plane orthogonal to the rolling axis immediately upstream of the inlet of a station of a first plurality of stations, said station being shown with the relative roll-holder cartridge in the operative position, already operatively connected to the roll control system and to the actuation device of the roll adjustment system.

As shown schematically in detail in FIGS. 6 and 7, the three rolls 131, 132, 133 or 231, 232, 233 of each cartridge 120 or 220 are rotatable around three respective axes of rotation R1, R2, R3 set at 120° with respect to each other. One of said rolls 131, 231 has its own axis of rotation R1 arranged vertically, while the other two rolls 132, 133 or 232, 233 have their respective axes of rotation R2, R3 inclined with respect to the vertical. The inclined axes of rotation R2, R3 each form an angle of 60° with respect to the vertical direction.

Each of the aforementioned rolling stations 100 or 200 comprises three actuators 141, 142, 143 or 241, 242, 243 mounted on the load-bearing structure 110, 220 and suitable to act—each on a respective roll 131, 132, 133 or 231, 232, 233—along the three respective radial axes T1, T2, T3 placed at 120° from each other.

By "radial axis" T1, T2, T3 of a roll it is meant the axis that is orthogonally incident the axis of rotation R1, R2, R3 of the roll and the rolling axis X.

Operationally, each of the actuators is suitable to act on the respective roll in order to maintain a predefined radial distance of the same roll 131, 132, 133 or 231, 232, 233 from the rolling axis X. The predefined radial distance is adjustable according to the nominal dimensions of the elongated product to be rolled and to optimize its tolerances by receiving the values measured continuously by a special measuring system located downstream of the rolling mill.

The set of three actuators of a rolling station defines the radial adjustment system of the rolls of the station itself.

Each of the aforementioned rolling stations 100 or 200 also comprises three gear motor groups 161, 162, 163 or 261, 262, 263 which are connected to the rolls by single extensions 171, 172, 173 or 271, 272, 273 so as to provide the rolls themselves with the rotation and the torque necessary to force the product to advance along the rolling axis X. In other words, as illustrated in the accompanying figures, each individual rolling station 100 or 200 is provided with three single extensions, one for each gear motor group and relative roll.

In each rolling station, the set of the three gear motor groups and the relative single extensions constitute a control system of the rolls with single controls.

Figure 9:
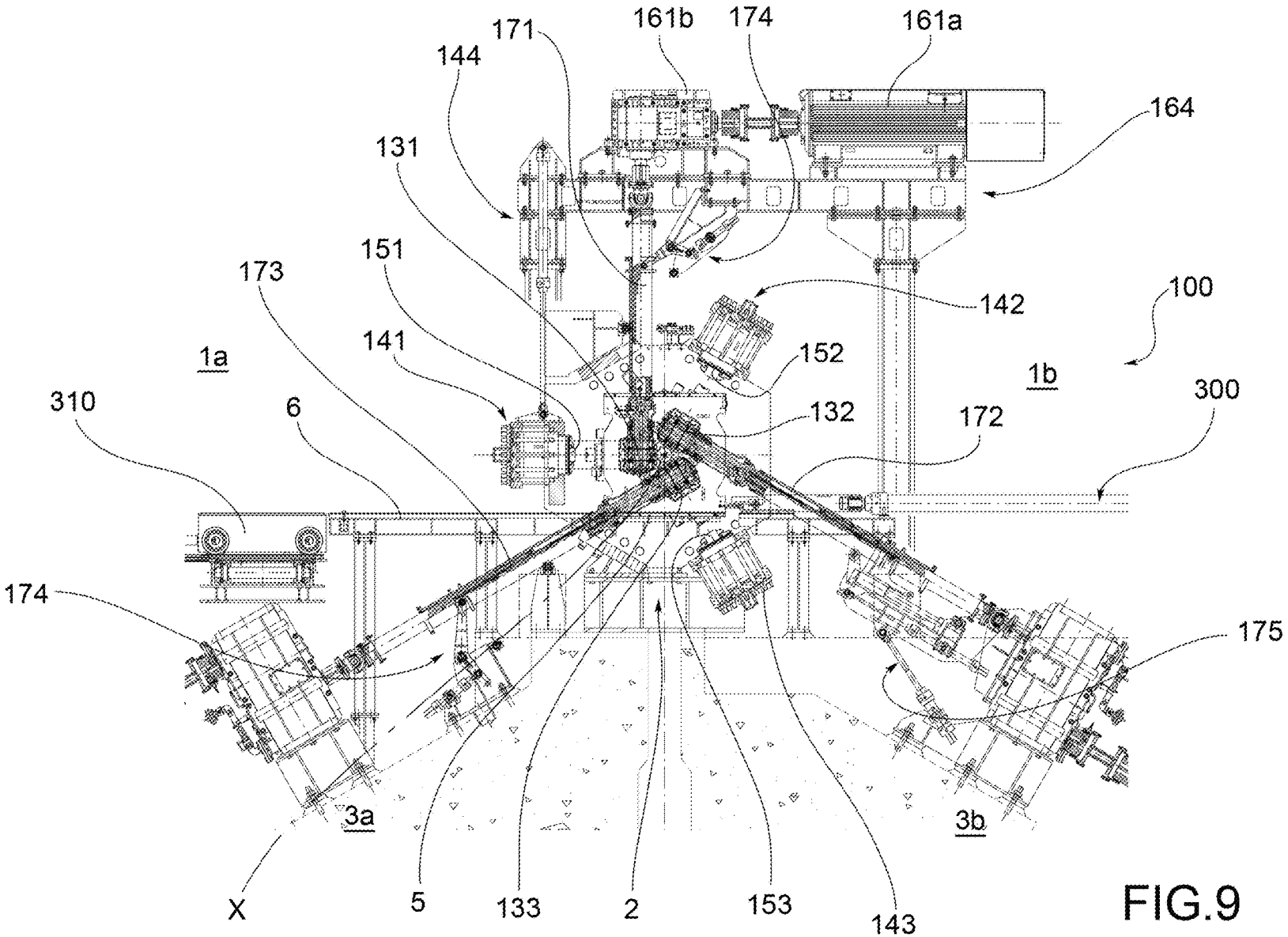
FIG. 9 shows an enlarged view of a part of the rolling mill illustrated in FIG. 8.
Figure 13:
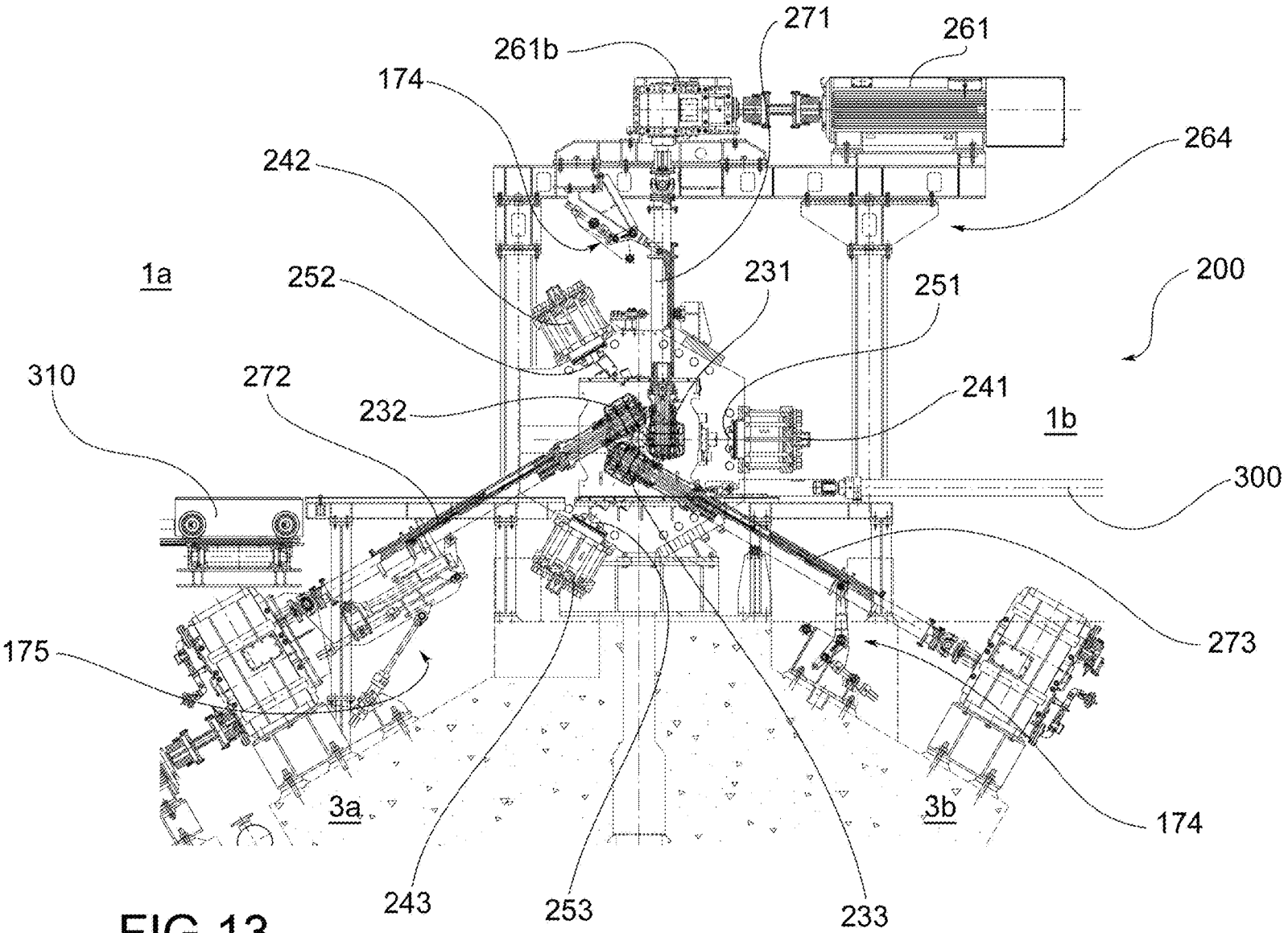
FIG. 13 shows an enlarged view of a part of the rolling mill illustrated in FIG. 12.
Figure 14:
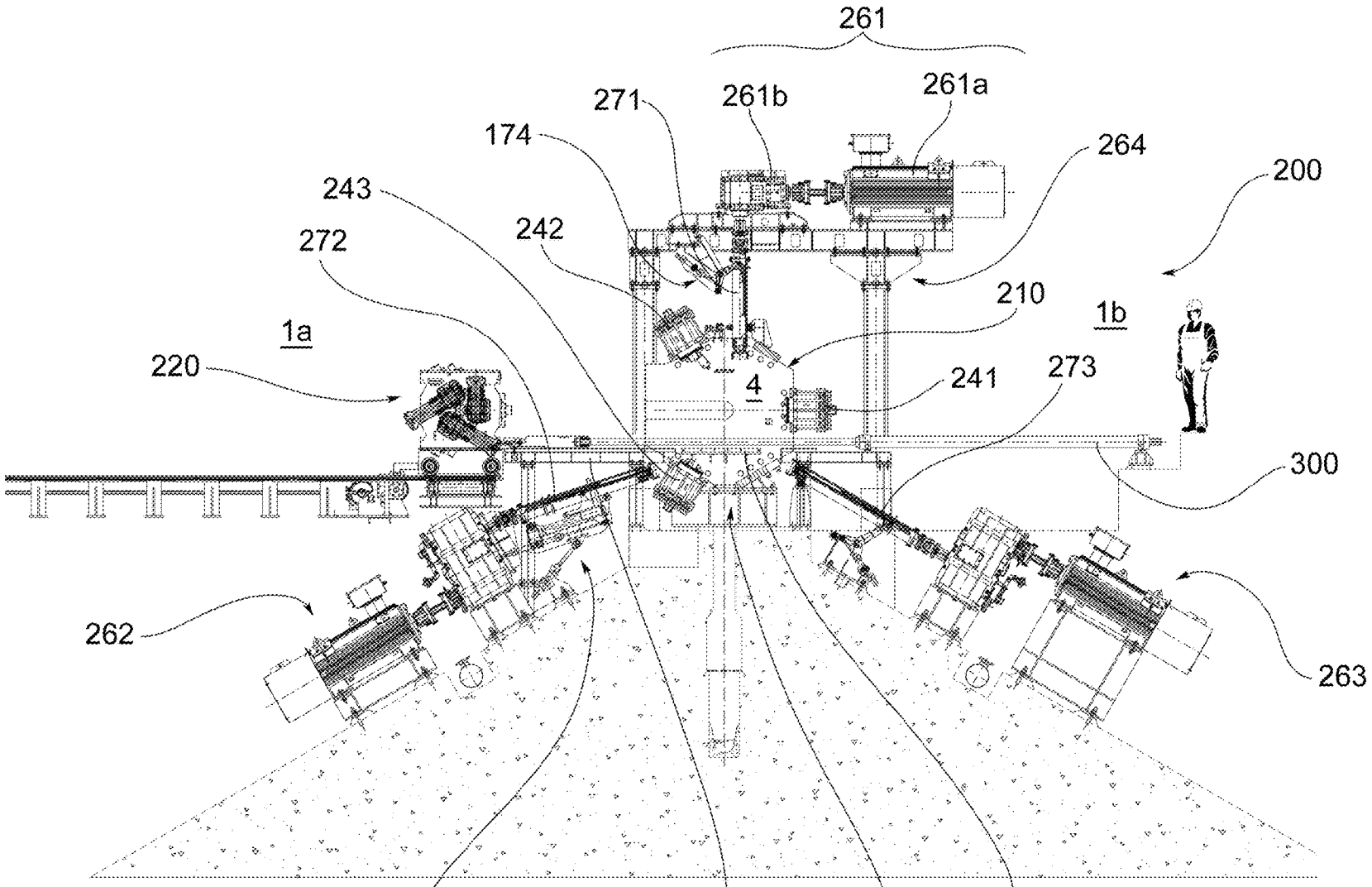
FIG. 14 shows the same sectional view of the rolling station of FIG. 12, wherein the station is shown with the relative roll-holder cartridge in the extracted position, operatively disconnected from the control system and from the adjustment system.

As may be seen by comparing, for example, FIGS. 9 and 13, the position of the rolls 231, 232, 233 of said second plurality of stations 200 is rotated by 60° about the rolling axis X with respect to the position of the rolls of said first plurality of stations 100.

By virtue of such angular arrangement of the rolls rotated between the stations 100 of the first plurality and the stations 200 of the second plurality, it is possible to roll the product, which slides along the rolling axis, in a uniform manner. In a given station, the grooved bottom of the respective rolls acts, in fact, on the portion of the product which in the previous station was not affected by the action of the rolls.

Furthermore, due to the aforementioned angular arrangement of the rolls rotated between two consecutive stations, the rolls 131 with a vertical axis of the first plurality of stations 100 are arranged on a first side 1*a* of the rolling mill 1, while the rolls 231 with a vertical axis of the second plurality of stations 200 are arranged on a second side 1*b* of the rolling mill 1, opposite the first with respect to the rolling axis X.

The arrangement of the rolls in the first plurality of stations 100 and in the second plurality of stations 200 is represented in a simplified manner in FIGS. 6 and 7, respectively. It may be observed that the rolls 131, 231 with a vertical axis have their relative radial axes T1 horizontal, while the inclined rolls 132, 133 and 232, 233 have their respective radial axes T2 and T3 inclined by 30° with respect to the vertical direction. With respect to a horizontal plane passing through the rolling axis X, it is also possible to identify an upper inclined roll 132, 232 and a lower inclined roll 133, 233.

With the expression "roll disposed on one side of the rolling mill" it is meant that said roll extends radially from the rolling axis towards the outside of the rolling mill in a horizontal direction on such side.

According to the invention, all the rolling stations 100, 200 of the rolling mill 1 are configured to allow the lateral extraction of the respective roll-holder cartridges 120 and 220 from the same side of the rolling mill 1, identified hereafter as "cartridge extraction side".

Such cartridge extraction side (which is the same for all rolling stations 100 and 200) may correspond to:

- the aforementioned said first side 1*a*, i.e., the side of the rolling mill 1 on which the rolls 131 with vertical axis of the first plurality of stations 100 are arranged; or
- the aforementioned second side 1*b*, i.e., the side of the rolling mill 1 opposite the first, on which the rolls 231 with vertical axis of the second plurality of stations 200 are arranged.

Preferably, as illustrated in the accompanying figures, the cartridges 120, 220 are extracted from the relative stations 100, 200 following an extraction path which lies on a horizontal plane defined by the aforementioned horizontal bottom wall 5 and by the support structure 6 outside the housing seat 4.

Still according to the invention, the rolling stations, having their respective rolls with vertical axis arranged on the cartridge extraction side, have the actuators of the rolls with vertical axis which are movable with respect to the load-bearing structure.

Operationally, the possibility of moving these actuators is aimed at freeing an extraction path for the respective cartridges. In these stations, the actuators of the rolls with an inclined axis are instead fixed with respect to the relative load-bearing structure.

The rolling stations, having their respective rolls with vertical axis arranged on the side opposite to the cartridge extraction side, have instead all the actuators of the rolls fixed with respect to the load-bearing structure. In these stations, in fact, none of the actuators are arranged along the cartridge extraction path.

The accompanying FIGS. 8 to 15 show an embodiment of the rolling mill 1 in which the cartridge extraction side is the first side 1*a* and in which, therefore, the rolling stations with movable actuators are the stations 100 of the first plurality of stations, while the stations with all the fixed actuators are the stations 200 of the second plurality of stations.

Obviously, it is possible to provide embodiments of the rolling mill 1 in which the extraction side is the second side 1*b* and in which therefore the rolling stations with movable actuators are the stations 200 of the second plurality of stations, while the stations with all the fixed actuators are the stations 100 of the first plurality of stations.

Preferably, each rolling station 100 with movable actuator is provided with means 144 for moving the actuator 141 operatively associated with the roll with vertical axis, between an operative position and a non-operative position. Such movement means 144 may be any, provided they are suitable for the purpose. In the embodiment illustrated in FIGS. 8 to 11, these movement means 144 consist of a hydropneumatic cylinder arranged above the respective rolling station 100, 200 by a scaffold 164.

Furthermore, the single extensions 171, 172, 173 and 271, 272, 273 of all the rolling stations 100, 200 may be moved with respect to the load-bearing structures 110, 210 of the respective stations so as to be able to disengage the respective rolls 131, 132, 133 and 231, 232, 233 and possibly free the extraction path for the cartridges.

A rolling mill 1 for solid elongated products having the features described above combines the possibility of extracting all the cartridges from the same side with a simplified roll control system which does not require special angular gearboxes.

As already highlighted, the control system of the rolls of each single station consists of three gear motor groups 161, 162, 163 or 261, 262, 263 connected to the rolls by single extensions 171, 172, 173 or 271, 272, 273. The control system therefore provides a dedicated gear motor group for each roll. By virtue of this, it is possible to spatially arrange each gear motor group according to the position of the respective roll, with a kinematic connection between the group and the roll defined by a single extension. This avoids the need to adopt kinematic connection solutions by double extensions connected to each other by special angular gearboxes, solutions which are unavoidable in the case of rolling mills with a single motor control system for all the rolls of a cartridge.

By virtue of this configuration of the control system and the spatial distribution of the rolls which in each station provides a roll with a vertical axis of rotation, in each station it is also possible to arrange one of the three extensions vertically and the remaining two extensions (dedicated to the two inclined rolls) on two axes substantially at 60° with respect to the vertical. In other words, in all the rolling stations it is possible to avoid in a simple way having extensions (with the relative gear motor groups) directly below the rolling stations, making them more easily accessible for maintenance activities.

By virtue of the invention, the preparation of this free path on the same side of the rolling mill requires only the movement of the actuator dedicated to the rolls with vertical axis, in addition to the movement of the extensions. As already pointed out, it should be noted that the movement of these actuators is not necessary in all the stations, but only in the stations which have the vertical axis roll arranged on the cartridge extraction side.

The configuration of the control system also avoids the positioning of gearboxes directly below the rolling stations. This avoids at the root the problems related to the infiltration of water into the lubrication system through the gearboxes.

Preferably, as illustrated in the accompanying figures, the single extensions 171, 172, 173 and 271, 272, 273 are arranged so as to be substantially aligned in an axial direction with the axes of rotation R1, R2, R3 of the respective rolls 131, 132, 133 and 231, 232, 233, when operationally connected to them.

The expression "extension with axis aligned with the axis of rotation of the respective roll" means the average alignment position that occurs during the transmission of motion to the rolls, net of the radial adjustments of the rolls according to the nominal dimensions of the product and tolerance optimizations.

In this way, preferably, in each rolling station the extension 171, 271 dedicated to the roll with vertical axis is arranged vertically, while the remaining two extensions 172, 173 and 272, 273 (dedicated to the two inclined rolls) are arranged on two axes substantially at 60° with respect to the vertical.

According to the embodiment illustrated in the accompanying figures, the extensions 171, 271 associated with the rolls 131, 231 with vertical axis are axially arranged vertically and are associated with the respective gear motor groups 161, 261, each of which comprises a motor 161*a*, 261*a* horizontally and an angular gearbox 161*b*, 261*b* in which the input shaft and the output shaft form an angle of 90°. In particular, each of such gear motor groups 161, 261 is supported above the respective rolling station 100, 200 by a scaffold 164, 264.

According to an alternative embodiment not shown in the accompanying figures, the extensions 171, 271 associated with the rolls 131, 231 with vertical axis are axially arranged vertically and may be associated with the respective gear motor groups 161, 261, each of which comprises a vertically arranged motor and a gearbox with parallel axes of the input and output shafts. In particular, each of such gear motor groups 161, 261 is supported above the respective rolling station 100, 200 by a scaffold 164, 264.

Preferably, the extensions 172, 173 and 272, 273 associated with the rolls 132, 133 and 232, 233 with inclined axes are associated with the respective gear motor groups 162, 163 and 262, 263 each of which comprises a motor and a gearbox with parallel axes of the input and output shafts. In particular, as illustrated in the accompanying figures, each of such gear motor groups 162, 163 and 262, 263 is arranged on a base 3*a* or 3*b* (foundations) defined by an inclined plane (preferably at 60° with respect to the vertical), which develops alongside the common ground support base 2, on one of the two sides 1*a* or 1*b* of the rolling mill parallel to the rolling axis X. Alternatively, the base 3*a* or 3*b* (foundations) may define a horizontal plane and the gear motor group be installed on the base with the necessary inclination.

Preferably, the gear motor groups 161, 162, 163 and 261, 262, 263 of all the rolling stations are fixedly mounted on the respective support bases. In this case (completely preferred), as will be clarified later in the description, the movement to disengage the extensions from the rolls (and possibly free the extraction path of the cartridges) is obtained by moving only the extensions, without therefore affecting the gear motor groups. This simplifies the system significantly.

As already highlighted above, the single extensions of all the rolling stations 100, 200 may be moved with respect to the load-bearing structures 110, 210 to disengage the respective rolls 131, 132, 133 and 231, 232, 233 and possibly free the extraction path for the cartridges.

Preferably, the extensions 171, 172, 173 and 271, 272, 273 of all the rolling stations 100, 200 may be moved with respect to the load-bearing structures of the respective rolling stations by at least one translation movement along their axis.

According to the preferred embodiment illustrated in the accompanying figures, the single extensions 171, 172, 173 and 271, 272, 273 have a telescopic structure. In this case, the aforementioned translation movement of the extensions along their axis (functional to disengage the respective rolls and possibly free the extraction path for the cartridges) may be obtained with an axial sliding movement between two or more different portions of the telescopic structure of the single extension.

According to an embodiment not shown in the accompanying figures, the single extensions 172, 173 and 271, 272, 273 may be configured so as to be able to slide along the gearbox shaft of the respective gear motor group. This sliding movement causes a translation of the extension along its own axis. Such axial sliding allows the extension to disengage from the hub of the respective roll and, if necessary, to free the extraction path for the relative cartridge.

The adoption of telescopic extensions may be provided as an alternative or in combination with the adoption of extensions sliding along the shaft of the respective gear motor group.

According to the preferred embodiment illustrated in the accompanying figures, in all the rolling stations 100, 200 at least one of the single extensions 172, 272 may be subjected to a roto-translation movement to disengage the respective roll 132, 232 so as to free the relative cartridge for extraction and if necessary free the extraction path for the cartridge itself.

From an operational point of view, with the same width of the translation movement, compared to a simple translation, a roto-translation allows an extension to be removed more markedly from the relative cartridge, thus making it possible that, without an excessive translation stroke, the extraction path of the cartridge from the rolling mill may be freed.

This solution may be adopted for all the extensions of a rolling station. However, this solution is preferably adopted only for the extension 172, 272 operatively associated with the upper inclined roll 132, 232. In fact, as may be observed in particular in FIGS. 9 and 13, the extensions which most invade the operative housing seat 4 are the extensions 172, 272 associated with the upper inclined rolls 132, 232.

It should be noted that the solution with roto-translational movement is preferably to be adopted for the extensions 272 associated with the upper inclined rolls in the rolling stations which have the vertical rolls arranged on the side opposite to the cartridge extraction side. In fact, in these stations the extensions of the upper inclined rolls are located along the cartridge extraction path and for this reason their complete movement is important.

Differently, the extensions 173, 273 associated with the lower inclined rolls 133, 233 and the extensions 171, 271 associated with the vertical rolls 131, 231 invade the respective operative housing seats 4 to a much lesser extent, thus requiring movements of a more limited width, which may be carried out with simple axial translations.

Preferably, each rolling station 100, 200 with movable actuator is provided with means 174, 175 for moving the respective extensions. Such movement means 174, 175 may be any, provided they are suitable for the purpose.

In the embodiment illustrated in the accompanying FIGS. 8 to 15, these movement means may consist of a simple lever mechanism 174 actuated by a hydropneumatic cylinder piston to generate simple translation movements (in particular for the extensions 171, 173, 271, 273). These movement means may instead consist of a device 175 for the axial translation of the extension, mounted on a rotatable base, to generate roto-translation movements (for the extensions 172, 272)

Advantageously, each of the actuators 141, 142, 143 and 241, 242, 243 comprises:

an adjustment element, suitable to directly engage the respective roll; and a control device, suitable to actuate said control element.

According to the embodiment illustrated in the accompanying figures, the actuators may be entirely mounted on the load-bearing structure 110, 220 of the respective station. In this case, both the control device and the adjustment element are mounted on the load-bearing structure 110, 220.

In particular, as illustrated in the accompanying figures, the actuators 141, 142, 143 and 241, 242, 243 may consist of hydraulic capsules, in which the respective adjustment elements consist of pistons 151, 152, 153 and 251, 252, 253 movable along the radial axes T1, T2, T3 of the respective rolls. As an alternative to the hydraulic capsules, the actuators may be of the mechanical type. In this case, preferably, the respective adjustment elements consist of adjustment screws movable along the radial axes T1, T2, T3 of the respective rolls.

According to an embodiment not shown in the accompanying figures, the actuators may be partially mounted on the load-bearing structure 110, 220 of the respective station. In this case, the control device is mounted on the load-bearing structure, while the adjustment element is mounted on the respective roll-holder cartridge. Preferably, in this case, the actuators are of the mechanical type, in which, in particular, the respective adjustment elements consist of adjustment screws movable along the radial axes T1, T2, T3 of the respective rolls.

In the case of actuators mounted entirely on the load-bearing structure of the respective stations (whether they are hydraulic capsules or mechanical actuators), the actuators 142, 143 and 242, 243 of each station associated with the rolls with an inclined axis are preferably arranged in such a way that, when the relative adjustment elements 152, 153 and 252, 253 are completely retracted, an extraction path free from obstacles is generated for the respective cartridge, parallel to the radial axis of the actuator 141, 241 associated with the vertical axis roll.

Preferably, this configuration of the actuators is adopted in the rolling stations 200 which have the roll with a vertical axis arranged on the side opposite to the extraction one. In this case, in fact, the adjustment elements of the actuators associated with the inclined rolls, if they were not completely retracted, would be located along the extraction path of the cartridge, thus creating an undercut for the cartridge itself. The actuator associated with the roll with a vertical axis, on the other hand, not being along the extraction path, may always be kept with the relative adjustment element in an advanced position.

More in detail, the rolling stations 200 with vertical axis roll arranged on the side opposite to the extraction one are configured in such a way that, when the adjustment elements 152, 153, 252, 253 of the actuators 142, 143, 242, 243 associated with the two inclined rolls are completely retracted, the minimum distance between the adjustment elements of the two actuators is greater than the maximum overall dimensions of the cartridge measured in the same direction.

The aforesaid configuration of the actuators may not be adopted in the rolling stations 100 which have the roll with a vertical axis arranged on the extraction side. In this case, in fact, the actuators associated with the inclined rolls are not located on the cartridge extraction path. Therefore, even if the respective adjustment elements were not completely retracted, they would not be in any case along the extraction path of the cartridge and would not create an undercut for the cartridge itself. The problem of the complete or partial retraction of the adjustment element does not arise for the actuator of the vertical roll. In fact, this actuator must in any case be moved as a block to free the extraction path.

Advantageously, each rolling station 100, 200 may comprise a device 300 for moving the respective cartridge along the cartridge extraction path.

In particular, this device 300 may be suitable both to move the cartridge out of the operative housing seat 4, and to bring it inside said housing seat.

Preferably, said movement device 300 is placed on the side 1*b* of the rolling mill 1 opposite the cartridge extraction side 1*a*.

More in detail, during the cartridge extraction step the device 300 exerts a pushing action on the cartridge, while during the positioning of the cartridge inside the housing seat 4 the device 300 exerts a pulling action on the cartridge.

By virtue of this configuration, the movement device 300 is never positioned in the space for maneuvering and changing the cartridge. This allows always having free space for cartridge maneuvering and change, allowing a direct connection from the rolling mill to the cartridge maintenance workshop. Such configuration also simplifies the structure of the movement device. In particular, no particular constructive measures are required to prevent the movement device from hindering the movements of the cartridge.

According to a preferred embodiment illustrated in the accompanying figures, the aforementioned movement device 300 consists of at least one hydropneumatic cylinder.

More in detail, the hydropneumatic cylinder 300 is arranged in such a way as to act in an axial direction parallel to the aforementioned horizontal bottom wall 5, which acts as a support base for the roll-holder cartridge 120, 220 inside the housing seat 4, and to the aforementioned support structure 6 for the cartridges which constitutes an extension of the bottom horizontal wall 5 outside the housing seat 4. Preferably, the hydropneumatic cylinder is arranged in proximity to the sliding plane of the cartridge, so as to exert its action at the base portion of the cartridge itself.

Operationally, once the three extensions and the three actuators of a rolling station have been disengaged from the rolls of the respective cartridge and a free path has been prepared from the housing seat towards the outside on the cartridge extraction side 1*a*, the movement device is operated. The cartridge is then pushed by the device 300 from the housing seat 4 through the support structure 6 up to a double-position change carriage 310 which receives the used cartridges extracted from the rolling mill and after a translation along an axis parallel to the rolling axis X brings the new cartridges into position to be inserted via the device 300 into the housing 4 by pulling them through the structure 6.

Figure 10:
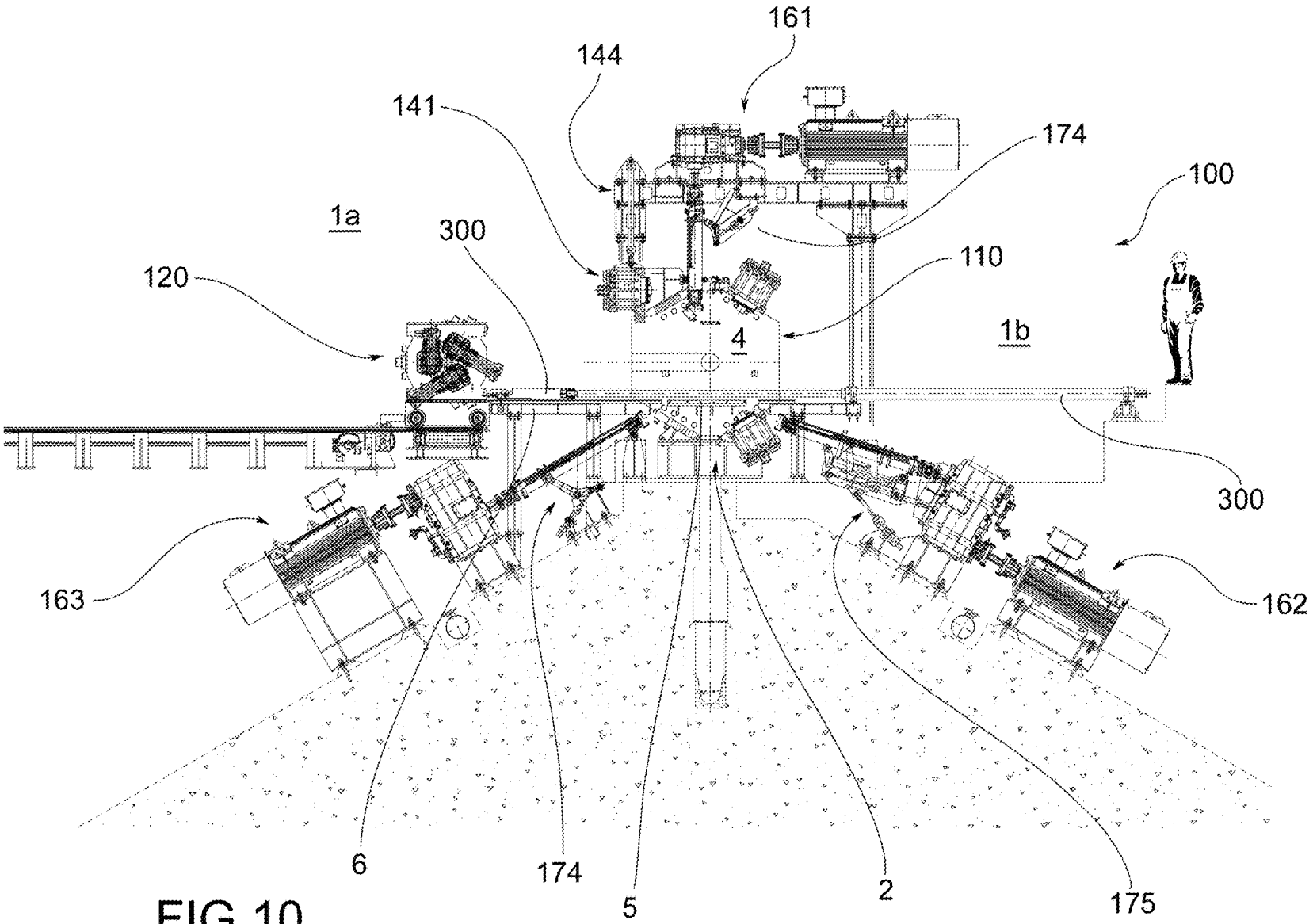
FIG. 10 shows the same sectional view of the rolling station of FIG. 8, wherein the station is shown with the relative roll-holder cartridge in the extracted position, operatively disconnected from the control system and from the adjustment system.

Preferably, as illustrated for example in FIG. 10, the same carriage 310 may be directly connected to a maintenance workshop by a rail transport system.

Advantageously, each rolling station 100, 200 is provided with a system for detecting the radial position of each of the respective rolls, so that it is possible to adjust the action of the actuators on the rolls themselves.

Preferably, at least in the rolling stations 100 provided with an actuator 141, 241 which may be moved with respect to the load-bearing structure, this system for detecting the radial position of the rolls is mounted on board the respective roll-holder cartridge and may be operably connected to the respective actuators.

Figure 16:
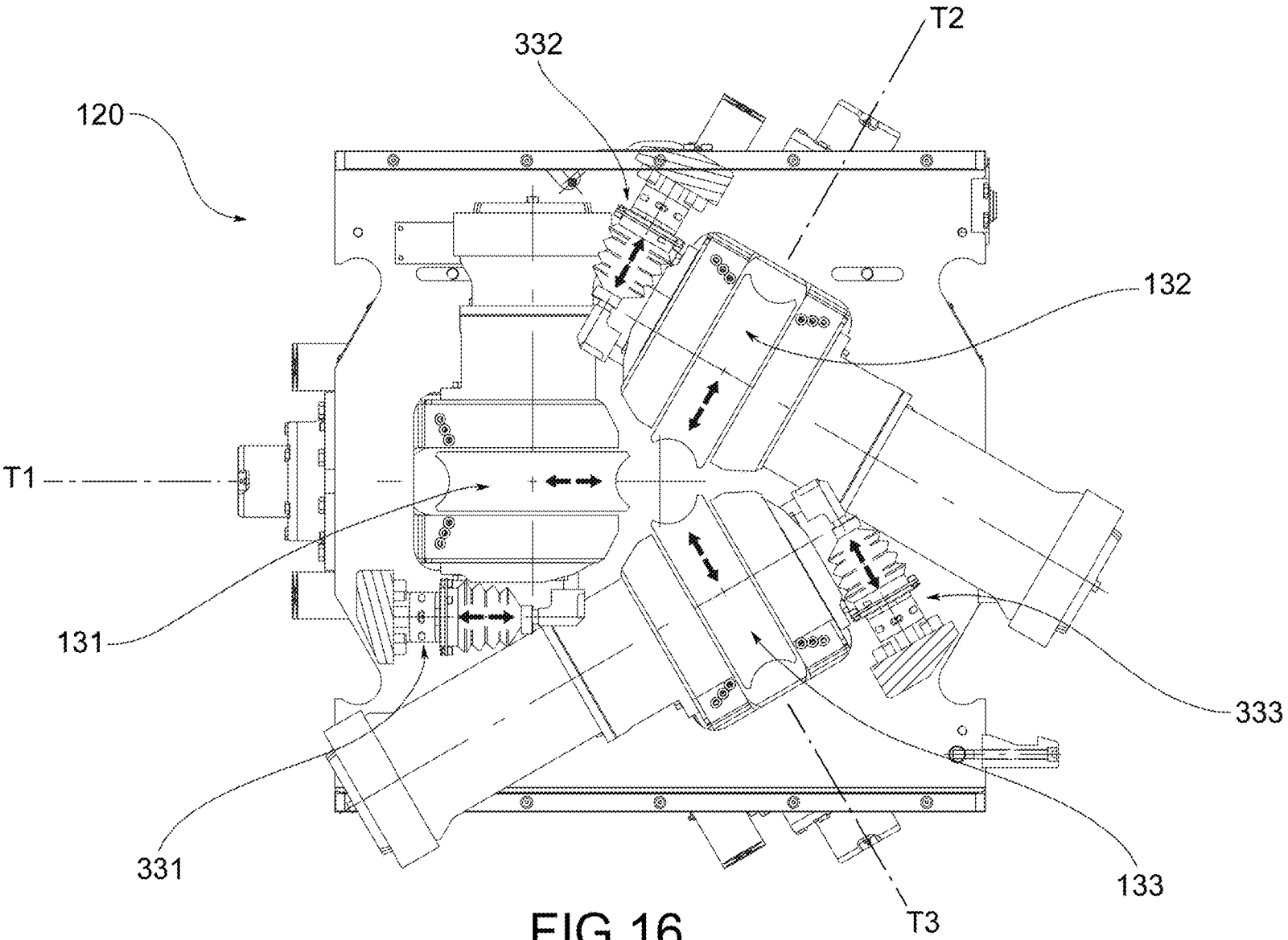
FIG. 16 shows an enlarged sectional view of a roll-holder cartridge of a rolling mill according to a preferred embodiment of the invention, provided with a system for detecting the radial position of the respective rolls.

More in detail, as shown for example in FIG. 16, such detection system on-board the cartridge comprises a transducer 331, 332, 333 for each roll 131, 132, 133. Each transducer detects the radial position of the respective roll and is suitable to transmit it to the respective actuator so that the latter may be adjusted accordingly.

By virtue of such detection system on the cartridge, it is possible to provide the actuators with the correct information on the radial position of the rolls, without being affected by the non-symmetrical movement under load of the actuators themselves, due to the fact that in the stations 100 of the first plurality of stations an actuator 141 is movable with respect to the load-bearing structure, while the other two actuators 142, 143 are fixed.

Operationally, the fact of having a movable actuator 141 would entail the disadvantage of a lower repeatability of the measurement of the radial position of the respective roll due to movement play and wear and greater looseness under load with respect to the fixed actuators. By adopting an on-board detection system, this disadvantage is eliminated.

As already mentioned, the system for detecting the radial position of the rolls on the cartridge may be adopted only in the stations 100 which have an actuator which is movable with respect to the load-bearing structure of the station. However, such on-board cartridge detection system may also be adopted in stations having all fixed actuators, so as to simplify the components, maintenance and logistical management of the rolling mill 1.

The invention allows numerous advantages to be obtained which have been explained in the course of the description.

The rolling mill 1 for solid elongated products according to the invention combines the possibility of extracting all the cages from the same side with a simplified roll control system which does not require special angular gearboxes.

The rolling mill 1 for solid elongated products according to the invention is also constructively simple to manufacture, with substantially lower manufacturing costs than traditional solutions which allow the extraction of all the cartridges from the same side of the rolling mill, especially in consideration of the fact that the gearboxes of the rolling mill according to the invention are standard and therefore readily available on the market with decidedly lower costs. There is also an additional advantage related to the position of the lower gearboxes. The latter, being far from the rolling axis and therefore from the source of heat, water and flakes of the rolling mill, are more reliable and moreover more easily accessible in case of maintenance.

The invention thus conceived therefore achieves its intended purposes.

Obviously, in its practical embodiment, it may also assume forms and configurations different from the one illustrated above without thereby departing from the present scope of protection.

Moreover, all details may be replaced by technical equivalent elements and the dimensions, the forms and the materials employed may be any, depending on the needs.

The invention claimed is:

1. A rolling mill for solid elongated products, defining a rolling axis, comprising a first plurality of rolling stations and a second plurality of rolling stations placed in series along the rolling axis alternated with each other between an input and an output of the rolling mill, wherein each of said rolling stations comprises:

a load-bearing structure;

a roll-holder cartridge removably connected to the load-bearing structure and comprising three rolling rolls mounted on the roll-holder cartridge to be radially mobile with respect to the rolling axis, the three rolls being rotatable around three respective axes of rotation placed at 120° from each other, one of said rolls having an axis of rotation arranged vertically and the other two of said rolls having respective axes of rotation inclined with respect to vertical;

three actuators mounted on the load-bearing structure and configured to act—each of the actuators on a respective roll—along three respective radial axes placed at 120° from each other, maintaining a predefined radial distance of each of said rolls from the rolling axis;

three gear-motor groups connected to the rolls by single extensions in order to provide the rolls with rotation and torque necessary to force a product to advance along the rolling axis;

wherein a position of the rolls of said second plurality of stations is rotated by 60° around the rolling axis with respect to a position of the rolls of said first plurality of stations so that the rolls with a vertical axis of the first plurality of stations are arranged on a first side of the rolling mill and the rolls with a vertical axis of the second plurality of stations are arranged on a second side of the rolling mill, opposite the first side with respect to the rolling axis;

wherein all the rolling stations of said rolling mill are configured to allow the lateral extraction of the respective roll-holder cartridges from a same side of the rolling mill, corresponding either to said first side or to said second side;

wherein the rolling stations having the respective rolls with a vertical axis arranged on the cartridge extraction side have the actuators of the rolls with a vertical axis that are movable with respect to the load-bearing structure in order to free an extraction path for the cartridges, wherein the actuators of the rolls with inclined axes are fixed with respect to the load-bearing structure;

wherein the rolling stations having respective rolls with a vertical axis arranged on the opposite side to the cartridge extraction side have all the actuators of the rolls fixed with respect to the load-bearing structure;

wherein the single extensions of all the rolling stations are movable with respect to the load-bearing structures in order to disengage the respective rolls and free the cartridge extraction path.

2. The rolling mill according to claim 1, wherein the single extensions are axially aligned with the rotation axes of the respective rolls when operatively connected to the respective rolls.

3. The rolling mill according to claim 1, wherein the single extensions associated with the rolls with a vertical axis are axially arranged vertically and are associated with respective gear-motor groups, wherein angular gearboxes have an input shaft and an output shaft forming a 90° angle between the input shaft and the output shaft, or have the input shaft and the output shaft parallel to each other.

4. The rolling mill according to claim 3, wherein the single extensions associated with the rolls with inclined axes are associated with the respective gear-motor groups, wherein the angular gearboxes have the input shaft and the output shaft parallel to each other.

5. The rolling mill according to claim 1, wherein the single extensions of all the rolling stations are translatable along their axis with respect to the load-bearing structures in order to disengage the respective rolls and free the associated cartridges for extraction.

6. The rolling mill according to claim 5, wherein the single extensions are telescopic and translation movement along their axis is obtained with a sliding movement of the relative telescopic structure.

7. The rolling mill according to claim 1, wherein the single extensions are configured to slide along a gearbox shaft of the respective gear-motor group in order to uncouple from a hub of the respective roll.

8. The rolling mill according to claim 1, wherein in all the rolling stations at least one of the single extensions is subjected to a rototranslation movement to disengage the respective roll and free the respective cartridge for extraction.

9. The rolling mill according to claim 1, wherein the gear-motor groups of all the rolling stations are mounted fixed on the respective bases.

10. The rolling mill according to claim 1, wherein each of said actuators comprises:

an adjustment element configured to directly engage the respective roll; and a control device configured to actuate said control element.

11. The rolling mill according to claim 10, wherein the actuators are entirely mounted on the load-bearing structure of the respective roll-holder cartridge, both the control device and the adjustment element being mounted on said load-bearing structure.

12. The rolling mill according to claim 11, wherein the actuators are hydraulic capsules and wherein the respective adjustment elements comprise pistons movable along said respective radial axes.

13. The rolling mill according to claim 11, wherein the actuators are mechanical and wherein, the respective adjustment elements comprise adjustment screws movable along said respective radial axes.

14. The rolling mill according to claim 10, wherein the actuators are partially mounted on the load-bearing structure of the respective roll-holder cartridge, the control device being mounted on said load-bearing structure, the adjustment element being mounted on the respective roll-holder cartridge.

15. The rolling mill according to claim 14, wherein the actuators are mechanical and wherein, the respective adjustment elements comprise adjustment screws movable along said respective radial axes.

16. The rolling mill according to claim 1, wherein each rolling station comprises a device for moving the respective cartridge along the extraction path.

17. The rolling mill according to claim 16, wherein said movement device is placed on the side of the rolling mill opposite the cartridge extraction side.

18. The rolling mill according to claim 16, wherein said movement device comprises at least one hydropneumatic cylinder.

19. The rolling mill according to claim 1, wherein each rolling station is equipped with a system for detecting a radial position of the respective rolls, said system being mounted on the respective roll-holder cartridge and being operatively connectable to the respective actuators.

* * * * *